United States Patent [19]

Rau

[11] 3,951,126

[45] Apr. 20, 1976

[54] COMPRESSED AIR FIREARM CONSTRUCTION

[75] Inventor: Arthur Rau, Westerstetten, Germany

[73] Assignee: J. G. Anschütz GmbH, Ulm, Germany

[22] Filed: June 3, 1974

[21] Appl. No.: 475,998

[30] Foreign Application Priority Data

June 8, 1973 Germany ..... 2329425

[52] U.S. Cl. ..... 124/67

[51] Int. Cl.[2] ..... F41B 11/00; F41F 1/04

[58] Field of Search ..... 124/13 A, 14, 15, 27, 124/28, 30 R; 42/74, 75 A, 75 B, 75 C, 77; 89/29, 160, 161, 162, 163, 164, 165, 166, 167, 168, 169, 170, 171, 172, 173, 174, 175, 176, 177; 267/168; 308/6 C

[56] References Cited

UNITED STATES PATENTS

| | | | |
|---|---|---|---|
| 1,191,877 | 7/1916 | Dickey | 124/13 A |
| 2,014,184 | 9/1935 | Linder | 42/75 B |
| 2,941,326 | 6/1960 | Hamil et al. | 42/75 A |
| 2,967,368 | 1/1961 | Williams | 42/75 A |
| 3,247,836 | 4/1966 | Westinger et al. | 124/15 |
| 3,439,441 | 4/1969 | Lawley | 42/75 A |
| 3,742,638 | 7/1973 | Archer | 42/77 UX |

FOREIGN PATENTS OR APPLICATIONS

| | | | |
|---|---|---|---|
| 33,598 | 4/1905 | Switzerland | 89/177 |
| 573,694 | 12/1945 | United Kingdom | 42/75 A |
| 707,201 | 6/1941 | Germany | 89/177 |
| 1,324,599 | 3/1963 | France | 267/168 |
| 1,393,735 | 2/1965 | France | 267/168 |

*Primary Examiner*—Richard C. Pinkham
*Assistant Examiner*—R. T. Stouffer
*Attorney, Agent, or Firm*—McGlew and Tuttle

[57] ABSTRACT

A compressed gas- or air-operated firearm, comprises a gun stock with a gun sleeve affixed to the gun stock and with a gun barrel having an associated compression cylinder adjacent the inner end thereof with a spring-actuated piston movable therein and an associated trigger mechanism which is movably supported within the gun sleeve by roller bearing structure. A power accumulator is arranged between the relatively movable parts and it biases the parts into a neutral position and includes structure for absorbing the reaction force due to the movement of the piston during operation of the weapon.

11 Claims, 7 Drawing Figures

COMPRESSED AIR FIREARM CONSTRUCTION

BACKGROUND OF THE INVENTION

1. Field of the Invention

This invention relates in general to the construction of guns and, in particular, to a new and useful compressed air operated gun having a spring-loaded compression piston and a breech housing mounted within a housing or sleeve of the firearm which is displaceable relative to the mounting sleeve and which includes a power accumulator between the relatively moving parts for establishing equilibrium therebetween and for absorbing the frictional and operational forces.

2. Description of the Prior Art

During the firing of air guns, a relatively high motion impulse is produced due to the compression piston which is driven in the firing direction by a strong spring. This motion impulse causes the recoil if it is not compensated within the arm. The recoil is disagreeable to the shooter and also prevents an accurate hit, because during the relatively long development of the discharge, the air gun is slightly thrown off the line of sight. That is why recoilless air guns have been developed which compensate the motion impulse of the compression piston and rest relatively quitely in the hand of the shooter during the discharge.

In a known air gun of this kind the entire system, or at least the breech housing and the barrel, is mounted on the stock of the arm displaceably, to obtain a freedom from recoil. Thus, at the discharge, the stock remains immobile while the system accelerated by the motion impulse of the compression piston is moved against the motion direction of the latter. The system comes to rest only after the compression piston, at the end of its travel, abuts against the cylinder head whereby its kinetic energy is compensated with that of the system. At this moment, however, the projectile has already left the barrel so that it can no longer be effected by the impact shock. The system is mounted on the stock by means of several friction bearings or leaf springs positioned transversely to the motion direction or by means of rolling bodies mounted in bearings.

Another known air gun operates on the same principle as described above. There is a difference, however, in that the breech housing and the barrel rigidly connected thereto are mounted for longitudinal displacement in a guide jacket tube which is secured to the stock.

Although these known compressed-air firearms are called recoilless, they are not completely free from shocks and deviations of the stock and the system during the firing, and particularly during the time of the discharge development. In contradistinction to the shocks produced at the impact of the compression piston on the cylinder head, these irregularities affect the motion direction of the projectile still moving through the barrel which is, of course, undesirable. These disturbances are not excessive but they are perceived by the shooter and may be quantitatively determined by measuring instruments. Such measurements have shown that at the firing, the guns are deviated mainly in the vertical plane by a rotational motion about their transverse axis and that the barrel muzzle is swung upwardly. A small recoil of the stock has also been determined. As compared to that, the measured transverse oscillations are relatively unimportant.

In searching for the disturbance variables causing these undesirable deviations, it has been found that the main cause is the unavoidable friction forces between the system and the stock. Basically, this finding is not new and an effort has already been made in the known air gun to minimize the friction forces by attempting to mount the system on rollers, for example. In such a mounting on rollers, the system is equipped at each end with two bearing bolts disposed at an angle to each other on which the runners are rotatably mounted. The runners roll on correspondingly obliquely positioned plane surfaces of two bearing members which are screwed to the stock. To prevent the system from being lifted from the bearing surfaces, there is provided a spring-loaded retainer which acts against the movable system by means of further axially mounted rollers pressing on the bearing surfaces.

However, as compared to the pure sleeve mounting, this kind of antifriction mounting has the disadvantage of being very expensive because many different component parts partly difficult to manufacture are needed, such as, bearing recesses, pieces with bores, journals, rollers, a retainer and prismatic parts of the bearing. Aside from these expensive parts, the remaining friction forces are in no way minimal because, due to the retainer, the forces acting on the system are considerably increased and the rolling bodies must be mounted on journals whereby the rolling friction is yet increased by the journal friction and the friction of the lateral guidance of the rollers. Additionally, the axially mounted rollers must have a relatively large diameter and consequently, their flywheel effect which increases with the square of the diameter, is no longer negligible. The flywheel effect is detrimental insofar as, the acceleration of the system, and therefore, of the rollers, it produces a reaction force upon the stock in the direction of the friction force. This is why the known roller mounting has been used in experimental constructions, but is not generally used in practice.

The mobile mounting of the system on the stock by means of leaf springs deflectable in the longitudinal direction of the gun is also unsatisfactory. The leaf springs must be relatively very stiff in order not to buckle under the weight of the system and to permit an exactly linear lateral guidance. As the system is displaced relative to the stock during the firing, the leaf springs are moved along and return forces are produced corresponding to the stiffness of the spring, which act directly on the stock and result in a minor recoil. Moreover, the return forces also produce tilting moments in the system and the stock which tends to turn these parts in the same direction which naturally affects the shooting accuracy. In addition, tilting moments are also produced in other seats or bearings by the friction forces because, for constructional reasons, the centers of gravity of the system and the stock cannot be positioned in the action plane of the friction forces.

Another drawback of the mobile mounting by means of leaf springs is the fact that after the discharge, the springs retransfer the deformation energy to the system and move the same back in the opposite direction. This "counter-recoil" into the initial position is certainly desirable but necessarily entails clattering after-oscillations of the gun.

SUMMARY OF THE INVENTION

In a compressed-air firearm comprising a system mounted in the arm for longitudinal displacement, the invention provides a compensation to thereby make ineffective the tilting moments and return forces produced by the bearing friction forces and tangential rotary acceleration forces of any present rolling bodies and of simultaneously improving the known roller mounting of the system so that the bearing reaction forces to be compensated do not occur at all in the hitherto usual magnitude, but are smaller.

In accordance with the invention, this problem is solved by providing a power accumulator between the breech housing or another part of the displaceable system and one of the parts of the arm carrying the system, whose power acts against the bearing friction forces as well as against the acceleration forces of the rolling bodies occurring in addition by the use of antifriction bearings and maintains the equilibrium at any instant of the return motion of the system, and by providing antifriction bearings capable of being loaded in any direction transversely to the motion direction and comprising only very small rolling members. The power accumulator may comprise two springs of which one spring produces a great force for compensating the starting resistance of the bearings but has an only short spring travel, while the other spring, having a relatively long spring travel and a low spring rate (= spring constant) compensates the kinetic friction of the bearings with a small force.

This discontinuous characteristic of the power accumulator showing a relatively great but only temporarily effective starting force and a small basic force, which, however, is effective along the whole return travel of the system, is necessary, in view of the also discontinuous and intermittently varying friction force characteristic of the system mounting. A body which, as the arm system at the discharge, is accelerated out from its standstill position, first exerts the so-called static friction or friction at rest on its support and only after coming into motion, this force decreases to the kinetic friction which then remains substantially constant.

In friction bearings, this characteristic is particularly distinct, however, this also applies to rolling bearings. In the latter case, another force to be considered in addition is the rotary and translatory acceleration force of the rolling members. This force must be taken into account particularly if the accelerations are very vehement as is the case in compressed-air firearms of this kind.

The more accurately the power accumulator reproduces the bearing reaction forces as to their magnitude and variation characteristic, the more successful is the suppression of the disturbing influences. In practice, of course, the adaptation is only approximative; it cannot be, nor is it required, that it be exact. It is sufficient if the power accumulator, as described, comprises two springs of different force and different spring travel. It is advantageous, if friction bearings are used in the system, when the stronger spring has a high spring constant so that even at a short travel, the spring force decreases rapidly. If antifriction bearings are used, the spring constant should be smaller and the spring travel slightly longer because of the additional acceleration forces of the rolling members. The weaker of the two springs needs a small spring constant and a long spring travel.

As soon as the arm system is brought into its position ready for firing again, after a discharge and new loading of the arm, the power accumulator is also put under tension. In the position ready for firing, the system is automatically locked and it is unlocked only after release of the discharge so that, at a possible oblique position of the arm in particular, it cannot retract unintentionally. These mechanisms have already been provided in the known compressed-air firearms.

In using antifriction bearings instead of friction bearings, the bearing friction is not only substantially lowered but it also remains more constant. A friction bearing is subject to friction variations by the gradual running and wearing in, oxidizing lubricants, or temporary dry run after a longer rest. The power accumulator does not adapt automatically to such friction variations so that antifriction bearings are preferable for the mounting of the system. However, because these bearings are exposed to high accelerations, their rolling members should have as small mass moments of inertia as possible which means small diameters. Recirculating ball bushings meet this condition.

Since, as mentioned, the power accumulator cannot compensate to 100 percent all of the friction forces in course of the system motion, a general reduction of the friction forces by antifriction bearings is advantageous since the residual forces also remain small.

Aside from weight carrying bearings, a linear guidance is also necessary which prevents a turning of the system about its longitudinal axis. The rectilinear guidance need not transfer any weight, and it has enough play so as not to over-determine or possibly jam other bearings.

The weight carrying bearings should be spaced from each other as much as possible in order to increase the stability of the mounting as a whole. It is advantageous therefore to provide a bearing both at the front end and rear end of the barrel for the breech housing. The rear bearing can also be located in the housing for the trigger mechanism if it forms a unit with the breech housing.

The rear end of the barrel facing the breech housing can be used very suitably as a journal. In this case, it is irrelevant if the barrel is rigidly connected to the gun sleeve secured to the stock or to the displaceable breech housing. If the barrel is connected to the breech housing, and is thus displaceable with respect to the gun sleeve and the stock, it is advantageously mounted in addition in a jacket tube at its muzzle. This jacket tube is rigidly connected to the gun sleeve and serves, apart from mounting the barrel, also as a support for the front sight means.

On the other hand, if the barrel is rigidly connected to the gun sleeve and the stock, the jacket tube serves as an additional weight for the system permitting the latter to absorb the motion impulse of the compression piston over a shorter distance. In this case, the jacket tube is connected to the system or to the head of the breech housing in a detachable manner. The connection is effected through two coupling hooks forming a part of the jacket tube and extending through corresponding tunnel-shaped recesses provided in the portion securing the barrel and engaging into a circular groove in the head of the breech housing in the manner of a bayonet catch. To permit also the transmission of transverse forces, in accordance with the invention, filling substances are placed into the circular groove sidewards of the hooks, which, in addition, ensures a centering of the jacket tube. Due to this measure, the jacket tube requires only a supporting seat in the zone of the barrel muzzle, so that not only a second bearing is saved, but additional friction forces are also eliminated.

The advantages obtained by the invention consist particularly in that the friction forces between the system and the stock are reduced and largely compensated. Without the compensating effect of a counteracting power accumulator, the friction forces would produce torques acting on the system and on the stock in the same direction and deviating the arm during the discharge. In the known compressed-air firearms, this becomes evident by a transverse motion of the barrel muzzle vertically upwardly. The forces of the power accumulator and the friction forces acting on the system and stock produce mutually counteracting torques compensating each other. It is irrelevant in this case at what distance the power accumulator is located relative to the effective cross-section of the friction forces. The condition of equilibrium according to which the sum of all forces and all torques must be equal to zero is thereby almost completely fulfilled.

Accordingly, it is an object of the invention to provide a compressed gas operated firearm, which comprises a gun stock, a gun sleeve head affixed to the gun stock and a gun barrel with an associated compression cylinder in which is movable a spring-actuated piston, which is operated by a trigger mechanism, all of which are relatively movable relative to the gun sleeve on roller bearings which include small diameter rollers and which may be loaded transversely, and also including a power accumulator between the relatively movable parts which biases the parts into an equilibrium position and absorbs the forces created by the frictional forces and by the movement of the piston during operation of the firearm.

A further object of the invention is to provide a firearm which is simple in design, rugged in construction, and economical to manufacture.

For an understanding of the invention, reference is made to the following description of typical embodiments thereof as illustrated in the accompanying drawings.

DESCRIPTION OF THE PREFERRED EMBODIMENTS

Figure 1:
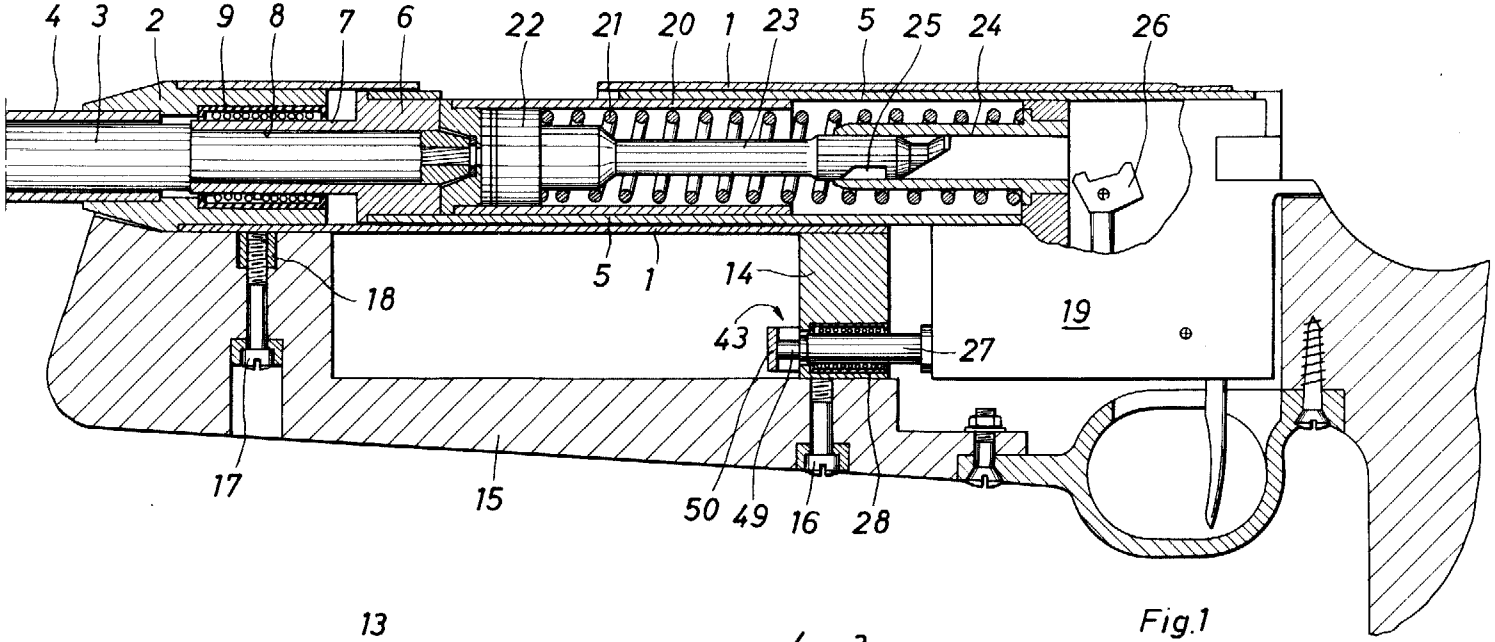
FIG. 1 is a partial longitudinal sectional view of an air gun constructed in accordance with the invention and with the parts shown after the discharge of the gun.
Figure 2:
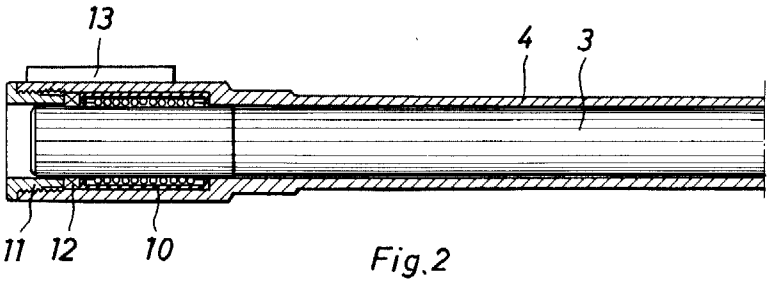
FIG. 2 is a longitudinal sectional view of the forward end of the gun shown in FIG. 1.
Figure 5:
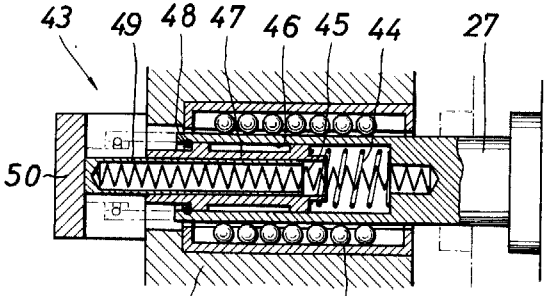
FIG. 5 is an enlarged longitudinal sectional view of a power accumulator employed with the embodiments of both FIGS. 1 and 3.

Referring to the drawings in particular, the invention embodied therein in FIGS. 1, 2 and 5, comprises an air gun having a gun sleeve 1 which is permanently joined to a bearing head 2 at the forward or barrel facing end. The barrel 3 extends through the bearing head and a jacket tube 4 surrounds the barrel without contacting it and the jacket tube in turn is connected rigidly to bearing head 2. A breech housing 5 is located in gun sleeve 1 with a large radial play and a head 6 of the breech housing is secured to the front end of the housing facing barrel 3. Head 6 of the breech housing comprises a cylindrical pin 7 extending in the firing direction, and an axial through-bore 8 embracing and undisplaceably retaining the stock end of barrel 3. Bearing means in the form of a recirculating ball bushing 9 is inserted into the bearing head 2 in which pin 7 and, thereby, breech housing 5, along with barrel 3, are mounted for longitudinal displacement.

FIG. 2 shows another bearing zone provided at the barrel muzzle and the bearing means also includes a recirculating ball bushing 10 which is inserted into an enlarged bore of jacket tube 4 and supports barrel 3. In the axial direction, recirculating ball bushing 10 is fixed in the jacket tube 4 by a hollow screw 11 with a radial sealing 12 therebetween. A sight saddle 13 for fixing sight means is mounted on the head of jacket tube 4.

On the rear end of gun sleeve 1, remote from barrel 3, a bearing block 14 is mounted, resting by its base against a stock 15 and retained by means of a screw 16. The barrel end of gun sleeve 1 also rests on stock 15 and is held in firm contact with the latter by a screw 17 which is screwed into a threaded piece 18 secured to gun sleeve 1.

A trigger mechanism 19 is rigidly mounted on the rear end of the breech housing 5 remote from the barrel. A loading lever (not shown) is hinged to the trigger mechanism 19 and acts on a compression cylinder 20 by means of a loading bar (not shown) in order to axially displace a compression piston 22 provided therein and thereby compress spring 21. The compression piston 22 comprises a piston rod 23 which is displaceably mounted in a guide sleeve 24 and formed with a notch 25 into which a sear 26 of the trigger mechanism 19 can engage to retain the compression piston 22 while spring 21 is compressed.

In accordance with the invention, a guide pin 27 projecting outwardly and extending parallel to the longitudinal axis of the barrel is inserted into the housing of trigger mechanism 19. Pin 27 serves to prevent a turning of breech housing 5 and of trigger mechanism 19 mounted therein. To this end, pin 27 is guided in a recirculating ball bushing 28 inserted in the bearing block 14, which bushing surrounds the pin with such a play that the unavoidable inaccuracies of fabrication in the transverse spacing of the two other recirculating ball bushings 9 and 10 (FIGS. 1 and 2), or to the recirculating ball bushings 40 and 42 (FIG. 3), which will be described hereinafter, are compensated. Therefore, guide pin 27 does not transfer any weight forces to bearing block 14. The weight of the system which, in the embodiment of FIGS. 1 and 2, comprises barrel 3, breech housing 5 with its content, trigger mechanism 19 and the (non-represented) loading mechanism, is carried by the ball bearing means comprising two recirculating ball bushings 9 and 10 alone.

Figure 3:
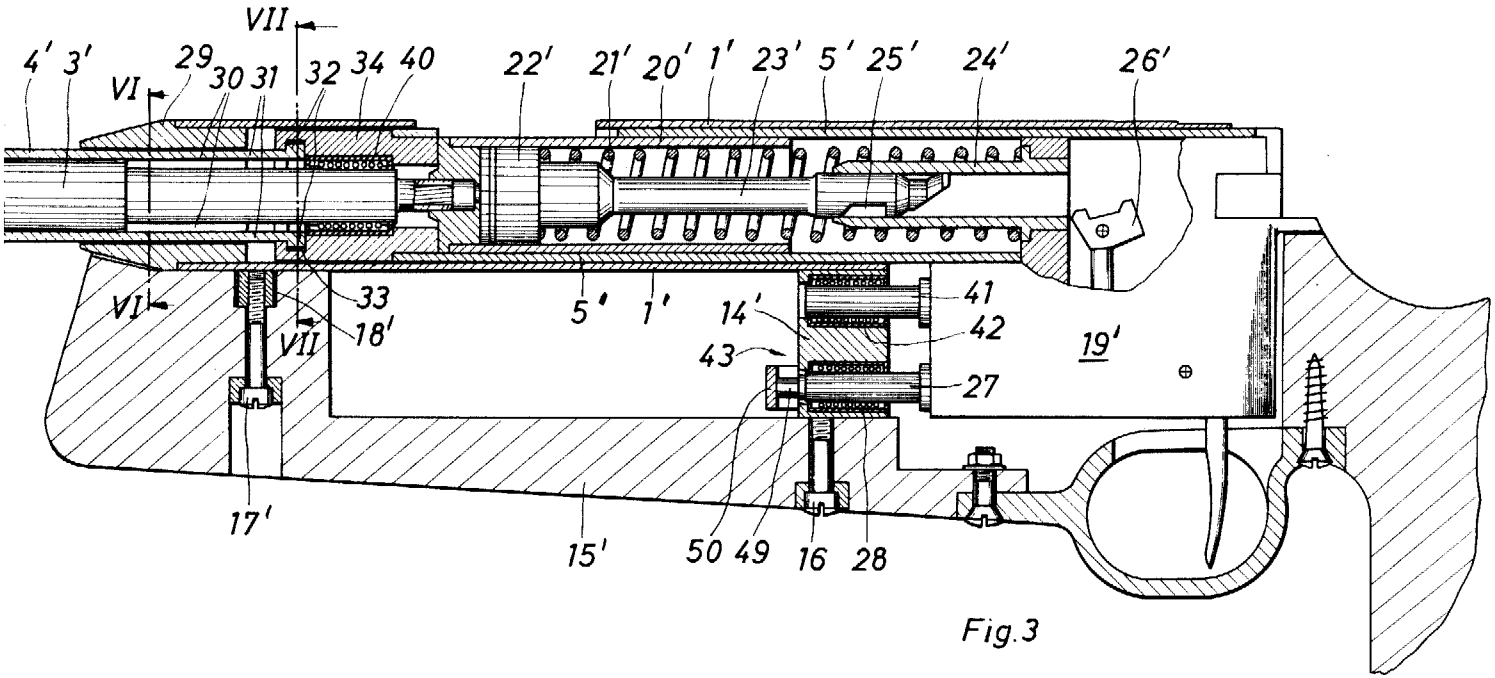
FIG. 3 is a partial longitudinal sectional view of another embodiment of the air gun.
Figure 4:
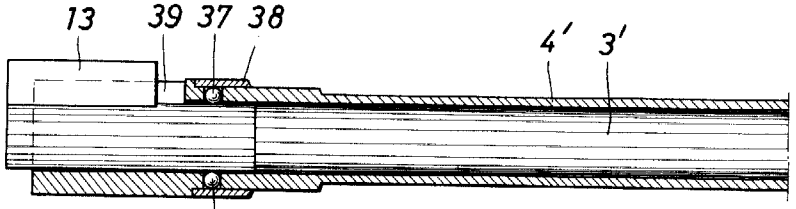
FIG. 4 is a partial sectional view of the forward portion of the gun shown in FIG. 3.
Figure 6:
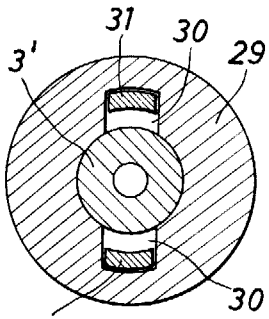
FIG. 6 is an enlarged sectional view of the gun shown in FIG. 3 taken along the line VI—VI.

FIGS. 3 and 4 show another embodiment of the air gun, which is distinguished from the first embodiment by the following changes: A barrel 3' is mounted non-displaceably and is not connected to a breech housing 5', but is rigidly fixed in a sleeve head 29 which is secured to a gun sleeve 1' (FIG. 6). Sleeve head 29 is formed with two diametrically opposite tunnel-shaped recesses 30 extending parallel to barrel 3'. A jacket tube 4' is mounted for longitudinal displacement and its end turned to the breech housing is provided with recesses on both sides so that it is formed with two elongated coupling hooks 31 forming a fork. The coupling hooks 31 are passed through the tunnel-shaped recesses 30. Each of their free ends is provided with a radially outwardly projecting cam 32 engaging into a circular groove 33 of a head 34 of the breech housing which is braized to the latter.

Figure 7:
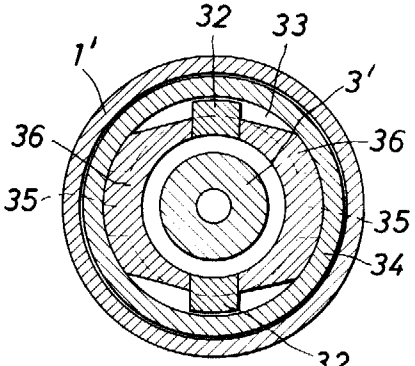
FIG. 7 is an enlarged sectional view of the gun shown in FIG. 3 taken along the lines VII—VII.

In order to permit introduction of cams 32 from the outside into circular groove 33, the groove is opened toward the front side of head 34 of the breech housing by two transverse openings 35 which are offset by 180°, see FIG. 7. As soon as cams 32 are passed through the transverse openings 35, all which need be done is to turn the breech housing through approximately 90° to obtain a form-closed connection with jacket tube 4 of the bayonet-catch type.

Further, two semi-annular filling pieces 36 are inserted into circular groove 33 preventing transverse displacements of coupling hooks 31 and, thereby, of jacket tube 4. In this connection, it should be noted, that in FIGS. 3, 6 and 7, the coupling hooks are shown as turned by 90° in order to show the construction more clearly. However, in the position shown, the hooks do not have the desired stiffness to securely transfer the weight force of the jacket tube to the head 34 of the breech housing. This is why they are not located one above the other, but rather, are located side-by-side. At the same time, they rest against the filling piece 36 located below.

Jacket tube 4', as shown in FIG. 4, is mounted on the barrel muzzle by means of balls 37 which can roll upon the surface of the barrel and are received in a plurality of radial bores of the wall of the jacket tube. Outwardly, the balls 37 apply against a bushing 38 which is firmly mounted on the head of jacket tube 4'. The head of jacket tube 4' is also formed with a recess 39 for the sight saddle 13 fixed to the barrel muzzle.

In the second embodiment of the air gun, according to FIGS. 3 and 4, jacket tube 4' does not serve as a support for the barrel as in the first embodiment, but serves as an additional mass for the system, intended to shorten the return travel at the discharge. Thus, although the shape of jacket tube 4 is substantially the same in both cases, its function is very different.

The head 34 of the breech housing is mounted on the barrel end turned to the breech housing for longitudinal displacement by means of a recirculating ball bushing 40. The second supporting point of the system comprises a bearing pin 41, secured to the housing of the trigger mechanism 19', and extending parallel to the longitudinal axis of the barrel, and a recirculating ball bushing 42 mounted in a bore of bearing block 14. This second bushing is very similar to the rectilinear guide comprising the guide pin 27' and the recirculating ball bushing 28'. However, it has not the large play of the latter.

The common part of both embodiments of the air gun is a compensation device for the bearing friction forces produced during the discharge, comprising a power accumulator, generally designated 43.

FIG. 5 shows this power accumulator 43 in detail and is the same for each embodiment. Its substantial elements are two pressure springs 44 and 45 having different diameters and mounted concentrically of each other in an axial stepped bore 46 of the already described guide pin 27. The pressure spring 44 rests against the bottom of stepped bore 46 and loads a piston 47 which is mounted for longitudinal displacement in the stepped bore 46 and, therefore, abuts a snap ring 48. The piston is formed with an axial bore and serves as a bearing for a hollow bolt 49 which can be displaced in the axial direction independently of the piston 47 and which is biased by the pressure spring 45 located partly in its interior.

A stop 50 is fixed to the stock 15 or particularly on the bearing block 14. The bolt 49 rests against this stop by its outer front surface. Stop 50 can be adjusted and readjusted in the longitudinal direction of piston 47 and bolt 49 by a non-represented means.

In FIG. 5, the solid lines show the position occupied by the parts of power accumulator 43 after the gun has been fired and a system, according to FIGS. 1 and 3, has been displaced back against the shooting direction. The position represented in FIG. 5 in fine broken lines is the changed position of guide pin 27 and piston 47 when the system is in its forward position ready for firing. In this position, aside from bolt 49, piston 47 also applies against stop 50. Guide bolt 27 is then displaced in the shooting direction so far that the piston 47 is lifted a small distance from snap ring 48 against which it previously applied. This distance can be adjusted to the desired value by means of the adjustable stop 50.

In the position of the system ready for shooting, pressure springs 44 and 45 exert a pressure on stock 15 in the shooting direction and an equal pressure on the system directed in the opposite direction. These forces have to equilibrate the friction and reaction forces of the system bearings in every phase of the discharge development, wherefore, the two pressure springs 44 and 45 must be exactly dimensioned for this purpose.

After the system, upon the release of the loaded compression piston 22, is set in motion against the acceleration direction of the piston, piston 47 is lifted from stop 50 after a short travel because snap ring 48 applies against piston 47 and entrains the same. The effect of pressure spring 44 is thereby eliminated. However, pressure spring 45 remains in action. Thus, shortly after the start of the system, a force jump is produced between the stock and the system corresponding to the friction-force jump in the bearing of the system.

It should be pointed out that instead of steel pressure springs 44 and 45, the power accumulator may also comprise penumatic force generators, such as, closed elastic gas bags or gas cylinders with pistons. It is also possible to replace the power accumulator 43 by an electromagnet in which, at the start, the armature is attracted with a strong force and then attracted and moved with a small force. This would render the force controllable.

While specific embodiments of the invention have been shown and described in detail to illustrate the application of the principles of the invention, it will be understood that the invention may be embodied otherwise without departing from such principles.

What is claimed is:

1. A compressed air firearm, comprising an air gun housing having a bearing head, a gun barrel having a barrel bore, a breech housing secured to said gun barrel, bearing means comprising antifriction bearings in said bearing head, said bearing means supporting said breech housing and said gun barrel for relative axial movement with respect to said air gun housing and having means for loading said bearings in directions transverse to the directions of axial relative movement between said air gun housing and said breech housing, a compression cylinder on said breech housing communicating with said bore of said gun barrel, a biased compression piston movable in said compression cylinder and carried by said breech housing, a power accumulator connected between said breech housing and said air gun housing and including means providing a biasing force between said breech housing and said air gun housing acting to orient said breech housing and said air gun housing in a selected equilibrium position, and said biasing force means comprising two pressure springs, one having a stronger biasing force than the other and with a relatively shorter spring travel than the one, and the other having a lesser biasing force than the one with a relatively longer spring travel than the one.

2. A compressed air firearm comprising an air gun housing, a gun barrel, a breech housing secured to said gun barrel, bearing means carried by said air gun housing comprising a small diameter roller bearing, said bearing means supporting said gun barrel and permitting relative axial movement of said gun barrel in relation to said air gun housing, a compression cylinder on said breech housing, a biased compression piston movable in said compression cylinder, power accumulator means connected between said breech housing and said air gun housing providing a biasing force between said breech housing and said air gun housing acting to orient said housings in a selected equilibrium position with respect to each other and including two concentrically arranged springs, one within the other, the inner one of said springs providing a relatively weak spring restoring force in respect to the outer one of said springs and having a relatively long spring travel with respect thereto, the outer one of said springs providing a relatively strong spring restoring force in respect to one of said springs and having a relatively short spring travel in respect to said inner spring.

3. A compressed air firearm, comprising an air gun housing, a stop attached to said gun housing, a gun barrel, a breech housing secured to said gun barrel, a trigger mechanism in said breech housing, roller bearing means on said gun housing supporting said breech housing for axial relative movement in respect to said gun housing, a compression cylinder on said breech housing, a biased compression piston movable in said compression cylinder, and power accumulator means connected between said breech housing and said air gun housing providing a biasing force between said breech housing and said air gun housing acting to orient said housings in a selected equilibrium position and comprising a pin positioned against said breech housing and having a bore which is opened at one end and closed at the other end thereof, a hollow piston slidable in said bore of said pin, a bolt slidable in said piston, an inner long spring of relatively slight restoring force engaged between said other end of said pin and said bolt to urge said bolt against said stop attached to said gun housing, and an outer larger diameter shorter length spring than said inner spring and of relatively stronger restoring force than said inner spring biased between said pin and said piston.

4. A compressed-gas operated firearm, according to claim 3, wherein said roller bearing means comprises recirculating ball bearings permitting longitudinal motion of said parts relative to each other.

5. A compressed-gas operated firearm, according to claim 3, wherein said roller bearing means includes a tube surrounding said barrel having a slot therein with a roller bearing engaged on said barrel.

6. A compressed-gas operated firearm, according to claim 3, wherein said bearing means comprises front and rear spaced roller bearings spaced apart as far as possible from each other.

7. A compressed gas operated firearm comprising an air gun housing having a bearing head, roller bearing means in said bearing head, a gun barrel having a barrel bore, a breech housing secured to said gun barrel, said gun barrel with said breech housing being supported on said roller bearing means for axial movement relative to said gun housing, a compression cylinder on said breech housing communicating with the bore of said gun barrel, a biased compression piston movable in said compression cylinder and carried by said breech housing, and power accumulator means connected between said breech housing and said air gun housing and providing a biasing force between said breech housing and said air gun housing acting to orient said housings in a selected equilibrium position, said gun housing having a gun sleeve, said breech housing having a tubular breech housing portion located within said sleeve and having a trigger mechanism housing portion located exteriorly of the gun housing sleeve, said bearing head comprising a tubular member secured to said gun sleeve, a jacket tube secured to said bearing head extending forwardly thereof around said gun barrel and being radially spaced from said gun barrel, said power accumulator means including a bearing block secured to said gun sleeve, a pin extending forwardly of the trigger mechanism of said breech housing and being relatively movable in said bearing block, said bearing block having linear bearings supporting said pin for relative movement in said bearing block.

8. A compressed-gas operated firearm, according to claim 7, wherein said gun sleeve includes a sleeve head portion, a breech housing surrounding said compression cylinder and carrying said trigger mechanism, a jacket tube spaced radially from said barrel and having a flange portion engageable with said breech housing, said breech housing including a head portion forwardly of said compression cylinder with roller bearings guiding said barrel for linear movement therein.

9. A compressed-gas operated firearm, according to claim 8, wherein said flange of said jacket tube and said head portion of said breech housing are provided with an interengageable bayonet joint.

10. A compressed-gas operated firearm, according to claim 9, wherein said accumulator means includes said pin, said pin having a bore with an opening at one end, an accumulator piston displaceable in said bore, a stop located alongside said pin, said accumulator piston being displaceable by a spring against said stop and a snap ring extending around said piston limiting the movement of said piston relative to the bore of said pin.

11. A compressed-gas operated firearm, according to claim 8, including another pin in addition to said pin extending forwardly from said trigger mechanism, said another pin being supported by linear bearings in said bearing block.

* * * * *